United States Patent [19]

Grabner et al.

[11] Patent Number: 5,057,752

[45] Date of Patent: Oct. 15, 1991

[54] CIRCUIT ARRANGEMENT FOR IGNITING AND OPERATING GAS-DISCHARGE LAMPS

[75] Inventors: Wolfgang Grabner; Otmar Bitsche, both of Graz, Austria

[73] Assignee: Stylux-Gesellschaft fur Lichtelektronik M.B.H., Graz, Austria

[21] Appl. No.: 474,802

[22] PCT Filed: Dec. 16, 1988

[86] PCT No.: PCT/AT88/00113

§ 371 Date: Jun. 15, 1990

§ 102(e) Date: Jun. 15, 1990

[87] PCT Pub. No.: WO89/06085

PCT Pub. Date: Jun. 29, 1989

[51] Int. Cl.[5] ..... H05B 37/00

[52] U.S. Cl. ..... 315/289; 315/244; 315/290

[58] Field of Search ..... 315/289, 290, 241 R, 315/244, DIG.5, DIG.7

[56] References Cited

U.S. PATENT DOCUMENTS

| | | | |
|---|---|---|---|
| 4,461,982 | 7/1984 | Fähnrich | 315/289 |
| 4,594,531 | 6/1986 | Ganser et al. . | |
| 4,683,404 | 7/1987 | Hitchcock | 315/289 |
| 4,958,107 | 9/1990 | Mattas | 315/289 |

FOREIGN PATENT DOCUMENTS

| | | |
|---|---|---|
| 3152342 | 4/1982 | Fed. Rep. of Germany . |
| 3420229 | 12/1985 | Fed. Rep. of Germany . |
| 2057795 | 4/1981 | United Kingdom . |
| 2204751 | 11/1988 | United Kingdom . |

*Primary Examiner*—Eugene R. Laroche
*Assistant Examiner*—A. Zarabian
*Agent*—Sandler, Greenblum & Bernstein

[57] ABSTRACT

A novel circuit for igniting and operating gas discharge lamps, in particular metal vapour lamps, comprises a buffer capacitor (C4) connected to a direct-current voltage (1,2) and connected in parallel with a circuit consisting of a choke and a capacitor connected in series (L1, C1). An electronic switch (S), for example a transistor and a recovery diode (D), is connected in parallel with the capacitor (C1). A second choke-capacitor series circuit (L2, C3) connected in series with the metal vapour lamp (L) is connected in parallel with the capacitor (C1), which is connected in parallel with the electronic switch (S). A second capacitor (C2) is directly connected in parallel with the the metal vapour lamp (L). The ignition circuit and the power supply circuit for the metal vapour lamp (L) are combined in this fluorescent lamp ballast, thus obviating the need for a separate ignition circuit. In addition, the circuit operates independently of the supply voltage.

20 Claims, 1 Drawing Sheet

CIRCUIT ARRANGEMENT FOR IGNITING AND OPERATING GAS-DISCHARGE LAMPS

The invention relates to a circuit arrangement for igniting and operating gas-discharge lamps, particularly metal-vapor lamps.

An almost endless variety of circuits for ballasts of gas-discharge lamps are known for a long time. Every one of these circuits employs for ignition the glow starter arranged in parallel with the lamp and, for current limitation during operation, the choke which is connected in series with the gas-discharge lamp. In these arrangements with glow starter and choke, no flicker-free instantaneous start is effected and, furthermore, lamp burning is not stable. The influence of mains voltage fluctuations on the lighting current of the lamp is likewise not inconsiderable. Since the glow starter comprises a mechanical switch which is a thermostatic bimetal switch, the risk of failure of the latter is relatively high.

Electronic ballasts have been developed to avoid these disadvantages. A circuit of this type is described in German Patent No. 31 52 342. Such circuit consists of a current source, an ignition circuit, a control element and an auxiliary voltage source. However, such a ballast requires a great deal of components and is therefore also quite susceptible to failure. Furthermore, it is conceived particularly for fluorescent lamps which require a lower ignition voltage than metal-vapor lamps. This ballast is thus entirely unsuitable for metal-vapor lamps.

The object of the invention is thus to provide an electronic ballast particularly for metal-vapor lamps requiring a high ignition voltage in the range of 2 kV to 5 kV.

The object is achieved by the invention. This is characterized in that a buffer capacitor, preferably an electrolytic capacitor, is connected to a rectified voltage, preferably the mains voltage rectified by means of a bridge rectifier, a choke-capacitor series circuit being in parallel with the buffer capacitor, whereby an electronic switch, preferably a transistor or thyristor, and a fast recovery diode forming part of the electronic switch are connected in parallel with the capacitor, and that the gas-discharge lamp provided with a parallel capacitor is connected by means of a further choke-capacitor series circuit to the parallel circuit consisting of capacitor, electronic switch and fast recovery diode. In this new type of ballast, the ignition circuit and the supply circuit are combined and can be considered as one unit. Therefore, a separate ignition circuit is also not required. Furthermore, the circuit operates independently of the supply voltage. Moreover, the gas-discharge lamp is always supplied with constant power. This even then when the lamp burning voltage changes, such burning voltage increasing with the age of the lamp.

An embodiment of the invention is characterized in that a further choke is provided in series with the parallel circuit consisting of capacitor, electronic switch and fast recovery diode. In this manner, the structural size of the two already existing chokes can be kept small.

It is advantageous that the choke of the further choke-capacitor series circuit is arranged in series with the parallel circuit consisting of capacitor, electronic switch and fast recovery diode. By virtue of this arrangement, the ballast according to the invention is excellently suitable for gas-discharge lamps with an ignition voltage less than 2 kV.

The invention will now be described in still greater detail in conjunction with the drawing.

In all three Figures there is a direct current voltage applied at the terminals 1, 2, which is normally the mains voltage rectified by means of a bridge rectifier. At this direct current voltage there is placed a buffer or smoothing capacitor C4.

This is generally an electrolytic capacitor having a high capacitance value. In the circuit depicted in FIG. 1, a choke-capacitor series circuit L1, C1 is connected in parallel with the buffer capacitor C4. An electronic switch S, which is customarily a transistor or thyristor, as well as a fast recovery diode D are connected in parallel with the capacitor C1 of this series circuit consisting of L1, C1. Furthermore, in the circuit of the electronic ballast according to FIG. 1 there is arranged a second choke-capacitor series circuit L2, L3 in parallel with the capacitor C1, this second choke-capacitor series circuit being connected in series with the : gas-discharge lamp L. Furthermore, the gas-discharge lamp L comprises a parallel capacitor C2.

Figure 1:
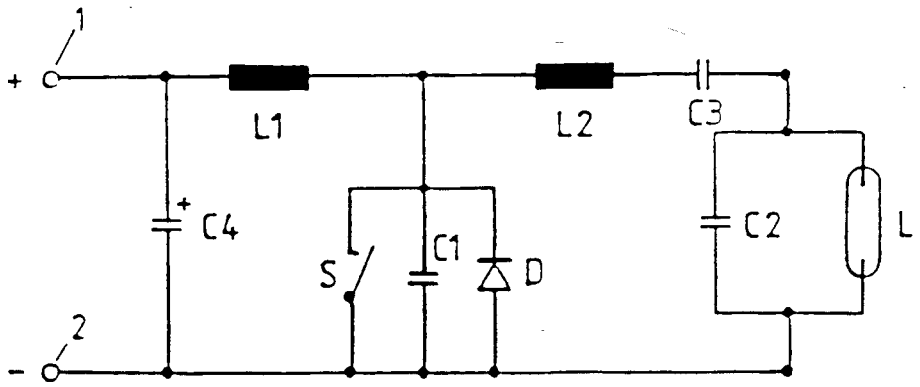
FIG. 1 shows the basic circuit of the electronic ballast.
Figure 2:
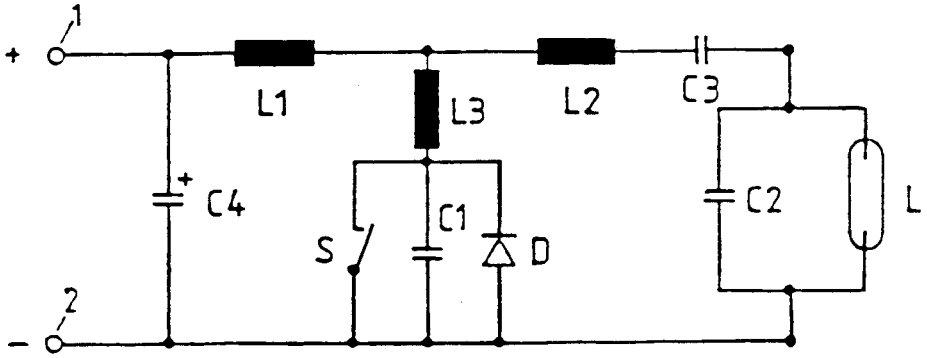
FIG. 2 shows the augmented circuit having three chokes.

The circuit depicted in FIG. 2 is basically identical with the circuit in FIG. 1. However, there is additionally provided a third choke L3 which is arranged in series with the capacitor C1.

Figure 3:
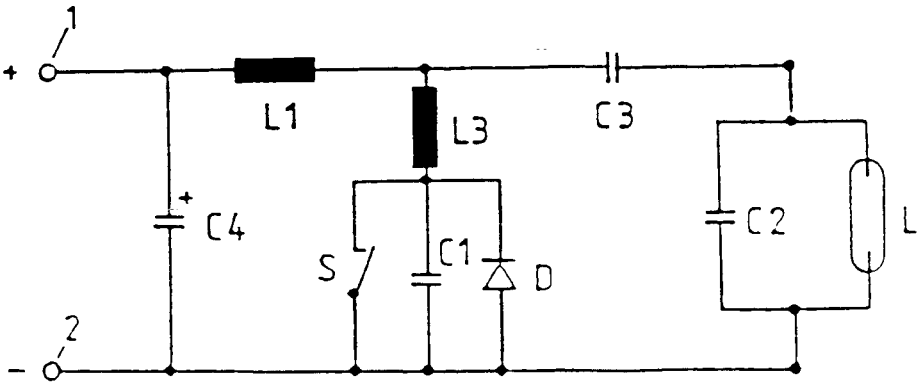
FIG. 3 shows the circuit for lamps with an ignition voltage of less than 2 kV.

A further variant of the embodiment of the electronic ballast according to the invention is illustrated in FIG. 3. In this variant the choke L2 series-connected to the capacitor C3 has been eliminated. Consequently, only the two chokes L1, L3 are provided in this circuit The circuits apparent from the three Figures are based on a series resonance circuit, whereby in each case there are provided a main oscillating circuit and a load circuit. The main oscillating circuit depicted in FIG. 1 consists of the choke L1 and the capacitor C1. On the other hand, the main oscillating circuit in FIGS. 2 and 3 is structured by the two chokes L1, L3 and the capacitor C1. The choke L2 and the two capacitors C2, C3 form the load circuit in FIGS. 1 and 2, while in FIG. 3 the choke L3 is part of the load circuit, since the choke L2 does not exist. The gas-discharge lamp L represents the consumer. The electronic switch S has to definedly excite the respective series resonance circuit. The smoothing capacitor C4 has to be dimensioned such that it always makes available the supply voltage which is required for the resonance circuit and is above all intermittence-free. For a stable oscillation behavior of the series resonance circuit, the inductances of the chokes L1, L2 as well as the capacitances of the capacitors C1, C2 must be in a predeterminate relationship to one another. The choke L2 in FIG. 1 and FIG. 2 serves for adapting the voltage ratios in the load circuit and at the gas-discharge lamp L, as well as for compensating the phase position of the main oscillating circuit. In the circuit of the ballast according to FIG. 3, the choke L3 takes over the above task of the choke L2.

The additional choke L3 in FIG. 2 is required for fine tuning of the series resonance circuit in unstable consumers.

In the circuits of the three Figures there has been selected in each case the negative potential as the common reference point. The positive potential could also be considered to be the common reference point, whereby the function of the circuit is perfectly preserved.

Finally, the mode of operation of the circuit during ignition and operation will now be described.

Prior to ignition or at the moment of ignition the gas-discharge lamp represents a high-ohmic load. In this operating instance the circuits operate as step-up transducers or as high-voltage ignition generators, whereby several kV high voltage are generated depending upon dimensioning.

The frequency determining components in the series resonance circuit at the moment of ignition are the capacitances of the capacitors C1, C2, C3 in all three circuits, plus the inductance of the choke L2 in FIG. 1, the inductances of the chokes L2, L3 in FIG. 2 and the inductance of the choke L3 in FIG. 3. The frequency of these resonance circuits upon ignition is a multiple of the frequency of the respective main oscillating circuit. By appropriate dimensioning of the capacitor C2 as a function of the capacitor C1 there is generated a high voltage of several kV at the gas-discharge lamp L as well as at the capacitor C2 itself, whereby the gas-discharge lamp L is ignited.

When the gas-discharge lamp L ignites as a result of a high voltage generated at the capacitor C2, this high voltage will abruptly break down at this capacitor C2 and at the gas-discharge lamp L. The oscillating-circuit frequency thereby decreases to that of the main oscillating circuit. Then only the operating voltage of the gas-discharge lamp L lies at the capacitor C2. The circuits in the three Figures now operate as step-down transducers, whereby the maximum oscillating-circuit voltage is divided between the components in the load circuit. The required energy for operating the gas-discharge lamp L is transferred from the main oscillating circuit to the load circuit and made available to the lamp L.

We claim:

1. A circuit arrangement for igniting and operating a gas-discharge lamp, comprising a buffer capacitor that is connected to a rectified voltage, a choke-capacitor series circuit that is connected in parallel with said buffer capacitor, whereby an electronic switch and a fast recovery diode forming part of said electronic switch are connected in parallel with said capacitor of said choke-capacitor series circuit, said gas-discharge lamp being provided with a parallel capacitor that is connected by means of a further choke-capacitor series circuit to said capacitor, electronic switch and fast recovery diode.

2. The circuit arrangement according to claim 1, further comprising a choke that is provided in series with said capacitor, electronic switch and fast recovery diode.

3. The circuit arrangement according to claim 1, wherein said choke of said further choke-capacitor series circuit is arranged in series with said capacitor, electronic switch and fast recovery diode.

4. The circuit arrangement of claim 1, wherein said buffer capacitor comprises an electrolytic capacitor.

5. The circuit arrangement of claim 1, wherein said rectified voltage comprises a voltage that is rectified by a diode.

6. The circuit arrangement of claim 5, wherein said diode comprises a bridge rectifier.

7. The circuit arrangement of claim 1, wherein said electronic switch comprises a transistor.

8. The circuit arrangement of claim 1, wherein said electronic switch comprises a thyristor.

9. The circuit arrangement of claim 1, wherein said gas-discharge lamp comprises a metal-vapor lamp.

10. A circuit arrangement for igniting and operating a gas-discharge lamp that is connected to a rectified voltage having a buffer capacitor, comprising:

a choke-capacitor series circuit that is connected in parallel with said buffer capacitor;

a parallel circuit formed by an electronic switch having a fast recovery diode that is connected in parallel with said capacitor of said choke-capacitor series circuit, said gas-discharge lamp being provided with a parallel capacitor that is connected via a further choke-capacitor series circuit to said parallel circuit.

11. The circuit arrangement of claim 10, wherein said buffer capacitor comprises an electrolytic capacitor.

12. The circuit arrangement of claim 10, wherein said electronic switch comprises a transistor.

13. The circuit arrangement of claim 10, wherein said electronic switch comprises a thyristor.

14. The circuit arrangement of claim 10, wherein said rectified voltage comprises a mains voltage that is converted to a d.c. voltage by a diode.

15. The circuit arrangement of claim 14, wherein said diode comprises a bridge rectifier.

16. The circuit arrangement of claim 10, further comprising a choke that is provided in series with said parallel circuit.

17. A circuit arrangement for igniting and operating a gas-discharge lamp, comprising:

a parallel circuit, comprising:

an electronic switch;

a fast recovery diode connected in parallel to said electronic switch; and a capacitor that is connected in parallel to said electronic switch;

a choke-capacitor series circuit, said capacitor of said choke-capacitor circuit being connected across two terminals of a rectified voltage source, said choke of said choke-capacitor series circuit being connected between one terminal of said rectified voltage source and one terminal of said parallel circuit, a second terminal of said parallel circuit being connected to a second terminal of said rectified voltage source;

a capacitor that is connected across said gas-discharge lamp, said gas-discharge lamp being connected to said rectified voltage source; and a further choke-capacitor series circuit that is connected between one side of said parallel circuit and one side of said capacitor that is connected across said gas-discharge lamp.

18. The circuit arrangement of claim 17, further comprising a further choke that is connected in series between said one side of said parallel circuit and said further choke-capacitor series circuit.

19. The circuit arrangement of claim 17, wherein said electronic switch comprises a transistor.

20. The circuit arrangement of claim 17, wherein said electronic switch comprises a thyristor.

* * * * *